US008978927B2

(12) United States Patent
Arakawa et al.

(10) Patent No.: US 8,978,927 B2
(45) Date of Patent: Mar. 17, 2015

(54) ARTICLE ADVANCING DEVICE AND ARTICLE ARRANGEMENT SHELF

(75) Inventors: Tatsuo Arakawa, Tokyo (JP); Kazunori Nakaya, Tokyo (JP); Koichi Yamazaki, Tokyo (JP)

(73) Assignees: Arakawa Kinzoku Co., Ltd, Tokyo (JP); Sekisui Plastics Co., Ltd, Osaka (JP)

( * ) Notice: Subject to any disclaimer, the term of this patent is extended or adjusted under 35 U.S.C. 154(b) by 690 days.

(21) Appl. No.: 12/994,587

(22) PCT Filed: May 26, 2009

(86) PCT No.: PCT/JP2009/059557

§ 371 (c)(1),
(2), (4) Date: Nov. 24, 2010

(87) PCT Pub. No.: WO2009/145160

PCT Pub. Date: Dec. 3, 2009

(65) Prior Publication Data

US 2011/0079605 A1 Apr. 7, 2011

(30) Foreign Application Priority Data

May 30, 2008 (JP) ..... 2008-142310

(51) Int. Cl.
*A47F 1/12* (2006.01)

(52) U.S. Cl.
CPC ..... *A47F 1/126* (2013.01)
USPC ..... 221/253; 221/221; 221/277; 221/279

(58) Field of Classification Search
USPC ..... 221/208, 253, 260, 279
See application file for complete search history.

(56) References Cited

U.S. PATENT DOCUMENTS

RE21,805 E * 5/1941 Greaves ..... 221/71
2,726,825 A * 12/1955 Ziskin et al. ..... 242/594.5

(Continued)

FOREIGN PATENT DOCUMENTS

JP 7-143927 A 6/1995
JP 2001-514950 A 9/2001

(Continued)

OTHER PUBLICATIONS

U.S. Appl. No. 12/955,142 to Kazunori Nakaya et al., filed Nov. 29, 2010.

*Primary Examiner* — Gene Crawford
*Assistant Examiner* — Kelvin L Randall, Jr.

(57) ABSTRACT

Provided are an article advancing device and an article arrangement shelf, wherein the article advancing device has a flexible sheet on which articles can be arranged at a condition where the sheet is extended, a roller to which one end of the sheet is fixed and which winds the sheet in the reverse extension direction, a drive means which rotates the roller in the winding direction of the sheet, and a wall member with which the articles in the first row of the articles arranged on the sheet come into contact. When the articles are arranged on the sheet, the article advancing device stops the winding operation of the sheet by the drive means by the contact of the articles in the first row with the wall member. The article advancing device has a simple article advancing function which employs a horizontally extending shelf basically having no incline and which does not require energy, such as electric power, and can be used regardless of the packaging state of the articles.

13 Claims, 10 Drawing Sheets

(56) References Cited

U.S. PATENT DOCUMENTS

| | | | | | |
|---|---|---|---|---|---|
| 3,166,195 | A | * | 1/1965 | Taber | 211/59.4 |
| 4,238,022 | A | * | 12/1980 | Williams | 193/32 |
| 4,303,162 | A | * | 12/1981 | Suttles | 211/59.3 |
| 4,351,439 | A | * | 9/1982 | Taylor | 211/59.3 |
| 4,729,481 | A | * | 3/1988 | Hawkinson et al. | 211/59.3 |
| 5,240,126 | A | * | 8/1993 | Foster et al. | 211/59.3 |
| 5,730,320 | A | * | 3/1998 | David | 221/279 |
| 5,881,910 | A | * | 3/1999 | Rein | 221/6 |
| 6,109,458 | A | | 8/2000 | Walsh et al. | |
| 6,142,317 | A | * | 11/2000 | Merl | 211/59.3 |
| 6,382,431 | B1 | | 5/2002 | Burke | |
| 2009/0078719 | A1 | * | 3/2009 | Guglielmi | 221/224 |

FOREIGN PATENT DOCUMENTS

| | | | |
|---|---|---|---|
| JP | 2003-267520 | A | 9/2003 |
| JP | 2005-110741 | A | 4/2005 |
| JP | 2006-61570 | A | 3/2006 |
| JP | 2007-82779 | A | 4/2007 |
| WO | 2007/020725 | A1 | 2/2007 |

* cited by examiner (A)

(B)

(A)

(B)

ARTICLE ADVANCING DEVICE AND ARTICLE ARRANGEMENT SHELF

TECHNICAL FIELD OF THE INVENTION

The present invention relates to an article advancing device and an article arrangement shelf with it for articles disposed at least in a depth direction, which forward an article in the second front row into the front row when another article in the front row is removed from the shelf, and specifically relates to an article advancing device and an article arrangement shelf which are suitable for a display shelf for commercial products.

BACKGROUND ART OF THE INVENTION

Conventionally known is a conveyer-type commercial products display shelf which has a mechanism to close up an empty space by forwarding commercial products to the front row. For example, Patent document 1 discloses a belt-conveyer-type commercial product display shelf driven by a motor and a skid-conveyer-type commercial product display shelf driven by gravity. Further, Patent document 3 discloses a gravity-driven commercial product display shelf made of a shelf board of which top surface has high sliding characteristics.

Furthermore, Patent document 2 discloses a storage shelf which can store articles in a row, and which pushes an article toward a slot for dispensing the article by pressing force of a spring. Furthermore, Patent documents 4 and 5 disclose the one where articles are pushed forward by a press body with resilience of a belt-shaped body, such as a belt-shaped tape and a belt-shaped steel plate.

PRIOR ART DOCUMENTS

Patent Documents

Patent document 1: JP07-143927-A
Patent document 2: JP2003-267520-A
Patent document 3: JP2007-082779-A
Patent document 4: JP2005-110741-A
Patent document 5: W02007/020725

SUMMARY OF THE INVENTION

Problems to be Solved by the Invention

Because the belt-conveyer-type commercial product display shelf disclosed in Patent document 1 utilizes rotative force of a motor as driving force, it requires electric power and consequently production cost and operational cost are raised. Further, because the one of skid-conveyer-type disclosed in Patent document 1 or the commercial product display shelf disclosed in Patent document 3 utilizes gravity as driving force, the cost can be minimized. However, because it requires additional space where the shelf board is inclined by a certain angle, the shelf can display articles less than the one with a horizontal shelf board.

The storage shelves which are disclosed in Patent documents 2, 4 and 5 require high production cost because of the complicated mechanism for controlling the pressing force properly, though they do not require any operational cost since they utilize the spring force or the resilience of a belt-shaped body. Furthermore, because the articles in a row are pushed toward the slot for dispensing the articles, it is difficult to arrange a soft packaging container of articles.

Accordingly, an object of the present invention is to provide an article advancing device and an article arrangement shelf, which have horizontal shelf boards without inclination basically and have simple function to advance articles requiring no energy such as electric power, being capable of arranging articles regardless of their packaging condition.

Means for Solving the Problems

To achieve the above-described object, an article advancing device according to the present invention is an article advancing device characterized in that the device comprises a flexible sheet on which articles can be arranged at a condition where the sheet is extended, a roller to which one end of the sheet is fixed and which winds the sheet in a reverse sheet-extension direction, a drive means for rotating the roller in a winding direction of the sheet, and a wall member with which articles present in a first row of the articles arranged on the sheet come into contact, and a winding operation of the sheet by the drive means is stopped by contact of the articles in the first row with the wall member when the articles are arranged on the sheet.

In the article advancing device according to the present invention, once an article disposed in the front row on the sheet is removed from the sheet, the roller which has been stopped by contact between an article in the front row and the wall member rotates, so that articles on the sheet are conveyed forward of the sheet in a row together with the sheet as the sheet is wound. When an article which has been disposed in the second front row moves into the front row of the sheet and is brought into contact with the wall member, the article which has been disposed in the second front row stops moving (conveying) and therewith the sheet stops moving in a roll-up direction, so that the roller stops again. Thus the article advancing device of the present invention can reduce production cost and operational cost because articles on the sheet are conveyed into the front row by a simple mechanism without energy such as electric power. Further, the present invention can prevent fouling and damaging of the bottom surface, which means the surface facing the shelf part, because the articles are moved (slid) forward by rolling up the sheet so that the articles themselves do not slide directly on the shelf part.

Furthermore, because the article advancing device according to the present invention makes it possible to horizontally form the shelf part, etc., on which the sheet is extended, the shelf can arrange more articles than the shelf with inclined shelf board. Besides, the shelf part can be slightly inclined, if necessary to make them easy-to-see at a display condition, for example.

In the article advancing device of the present invention, it is preferable that the drive means uses as a driving force a spring force, such as spring force by a flat spiral spring. The use of the spring force makes it possible to provide an article advancing device with a simple mechanism which does not consume energy.

In the article advancing device of the present invention, it is preferable that the drive means has a driving force adjusting means which can adjust a driving force. The driving force magnitude for a proper article advancing function differs by the weight of articles arranged on the sheet, for example. Therefore, when the roller or sheet, etc., is provided with such an adjusting means, the article advancing device of the present invention can handle various articles.

The article advancing device of the present invention preferably has a stopping means for stopping an operation of the sheet toward the winding direction. The article advancing function should not be performed in some cases, such as a time when articles are replenished on the sheet and a time when articles are removed from the sheet to change the article lineup. In such a case, such a stopping means can be used to temporarily stop the movement in the roll-up direction of the sheet.

In the article advancing device of the present invention, it is preferable that a sheet lifting part through which the sheet can pass at a condition where the sheet is lifted is provided for the sheet at a position near the roller. Such a sheet lifting part provided at the position near the roller makes it difficult to bring fine foreign substances into the roller even if the foreign substances come onto the sheet. In order to form the sheet lifting part, the roller at a position higher than a sheet-extension surface can be provided, and alternatively, a protrusion portion, which the sheet runs upon, on the shelf part, etc., on which the sheet is extended can be provided.

The article advancing device of the present invention can be configured such that a movable platform is connected to the other end of the sheet. Such a movable platform connected to the end of the sheet can make the article advancing function properly work even for comparatively heavy articles.

In the article advancing device of the present invention, it is preferable that a rotating element rotating in a moving direction of the movable platform or a linear element extending in a moving direction of the movable platform is provided to the movable platform. For example, a wheel as a rotating element or a convex portion as a linear element on the bottom surface of the movable platform can be provided, so that the frictional force between the movable platform and the shelf part which is loaded with the movable platform can be reduced, so as to rotate the roller more smoothly. Besides, the linear element can be formed such that the convex portion continuously extends in the moving direction of the movable platform, and alternatively, a plural of convex portions can be formed along the moving direction of the movable platform so as to extend as a whole in the moving direction of the movable platform.

The article advancing device of the present invention can be configured such that a connecting part between the sheet and the movable platform comprises a sheet holding member with a modified cross-sectional shape which is wrapped with the one end of the sheet around an outer circumference of the sheet holding member, and a retaining member which has an opening permitting the sheet to pass through in a condition where the sheet is folded and retains the sheet holding member wrapped with the one end of the sheet relative to an extending direction of the sheet itself. For example, applicable are the sheet holding member and the retaining member which are disclosed in JP2003-206651-A.

The modified cross-sectional shape in the above-described connecting structure implies a cross-section shaped in a shape other than a circle. The modified cross-sectional shape is preferably a polygonal shape, such as a triangle, a quadrangle and a pentagon, the triangle being the best among them. In addition, being a modified cross-sectional shape other than a circle is sufficient for a cross-sectional shape of the sheet holding member. The sheet holding member with the modified cross-sectional shape can hold and fix the end of the sheet wrapped therewith more surely into a desirable condition by collaboration with the retaining member. Specifically, it is preferable that a cross-sectional shape of at least a part of the sheet holding member at a position of a sheet extending-direction side is formed as a triangle, and that a section of an inner surface of the retaining member up to the opening is formed as a shape along the triangle. Such a structure makes it possible to fix the sheet at a certain condition as naturally fastening the end of the sheet by a wedge effect between the sheet holding member and the inner surface of the retaining member, when the sheet is extended. Further, the triangle part is automatically placed along a triangle part of the inner surface of the retaining member, so that the posture of the sheet holding member is naturally defined in a predetermined posture.

Furthermore, in order to prevent the sheet end from loosening and slipping more surely as keeping a condition where the end of the sheet is fixed and held at a predetermined posture between the sheet holding member and the retaining member, a convexoconcave for preventing the sheet end from loosening is preferably provided on the inner surface of the retaining member which retains the sheet holding member wrapped with the sheet end. Though the shape of the convexoconcave is not specifically limited, the sheet could be bitten into a shape such as convexoconcave with an unciform cross-section so as to be fixed definitively.

In such an article advancing device of the present invention, because the sheet holding member wrapped with the end of the sheet can be slid laterally along the sheet edge so as to be contained in the inner space of the retaining member, replacement of the sheet can be easily operated. Additionally, it can prevent the sheet from rucking at the sheet replacement.

The article advancing device of the present invention preferably further comprises an attachment part attached to a shelf part of an article arrangement shelf. The structure of the attachment part can be a screw-type or spring-type clamp structure. When the shelf part is made of metal, such as iron, the article advancing device can be attached to the shelf part by magnetic force. Further, the article advancing device can be adhered to fix with the shelf part as well as being formed integrally with the shelf part, when the roller itself is formed as easily detachable from the article advancing device, for the ease of maintenance of the roller.

Further in order to achieve the above-described object, an article arrangement shelf according to the present invention is an article arrangement shelf comprising a shelf part formed or attached with the article advancing device. The article advancing device composed as described above is attached with the shelf part of the article arrangement shelf, so that articles on the sheet can be fed into the front row by a simple mechanism without energy such as electric power, as achieving an article arrangement shelf with reduced production cost and operational cost.

In the article arrangement shelf according to the present invention, the roller is preferably provided on a lower surface side of the shelf part. When the roller is provided on the lower surface side of the shelf part, the space on the shelf can be utilized effectively and articles can be efficiently arranged on the article arrangement shelf. In addition, the roller gets out of sight of consumers, so as to prevent the consumers from losing their buying inclination.

In the article arrangement shelf according to the present invention, it is preferable that the shelf part has a rail or a groove for regulating a moving direction of a movable platform connected to an end of the sheet present at a position opposite to a position of the roller. If the movable platform slips greatly in a direction perpendicular to the sheet roll-up direction, some troubles, such as slack of the sheet and upset of articles, might be caused. Such troubles can be prevented and dissolved by providing the rail or the groove on the shelf part. In addition, when the movable platform is provided with a wheel or a convex portion on the bottom surface in order to make the roller rotate smoothly as described above, it is preferable that the rail or the groove is provided as engaged with the wheel or the convex portion on the bottom surface.

Effect According to the Invention

Thus the article advancing device and the article arrangement shelf according to the present invention can achieve a simple function for advancing articles without energy such as electric power, as using a horizontal shelf board without inclination. Such an article advancing device and an article arrangement shelf according to the present invention can be applied to handle various articles regardless of their packaging condition.

EMBODIMENTS FOR CARRYING OUT THE INVENTION

Hereinafter, desirable embodiments of the present invention will be explained in details as referring to figures.

Figure 1:
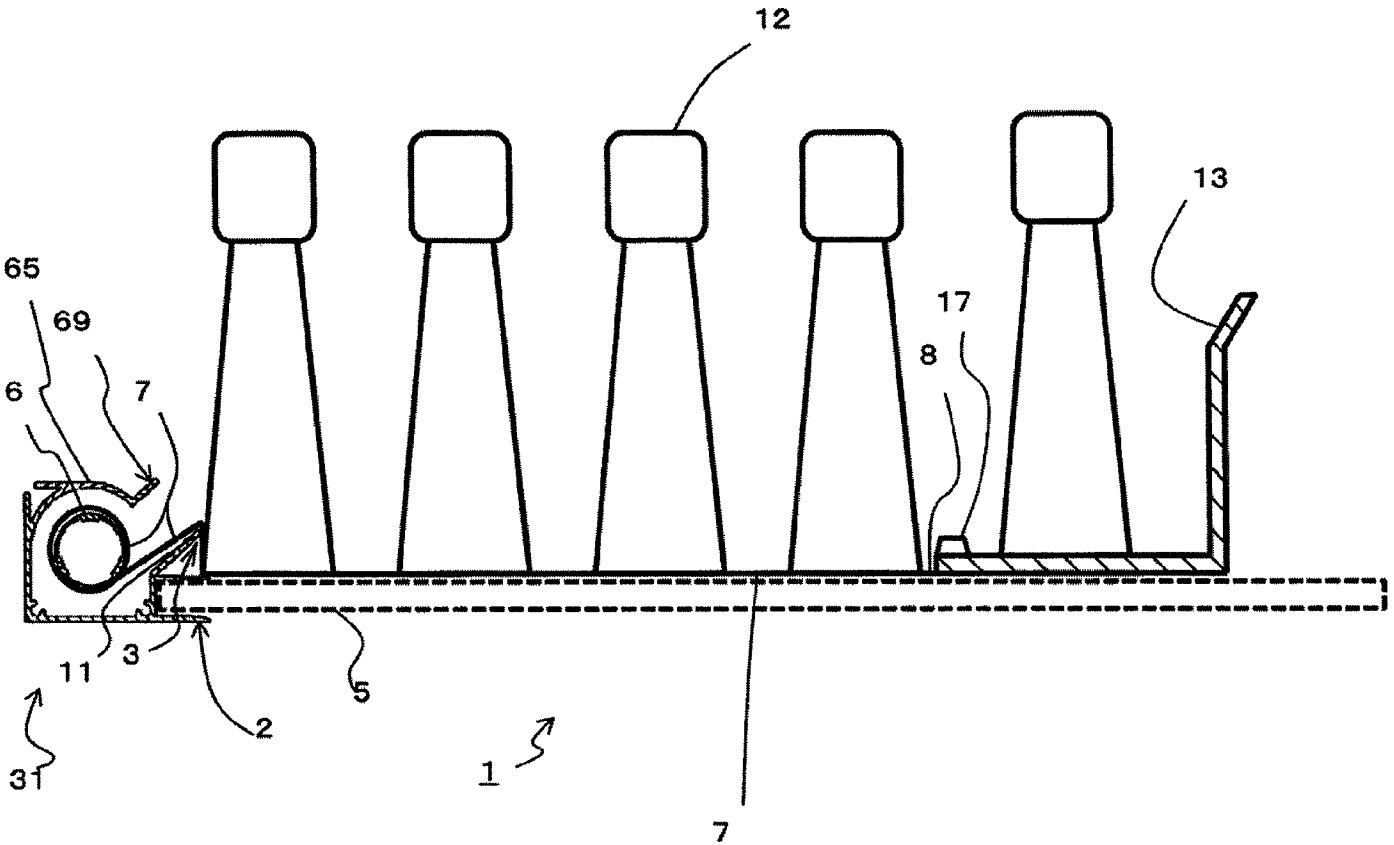
FIG. 1 is a schematic sectional view showing an article advancing device according to an embodiment of the present invention.

FIG. 1 is a schematic sectional view showing an article advancing device according to an embodiment of the present invention. Article advancing device 31 is attached to shelf part 5 with attachment part 2 having a cramp structure, so as to accomplish article arrangement shelf 1 as a whole. Flexible seat 7, which has been pulled out from roller 6 provided at a position slightly higher than shelf part 5 by sheet lifting part 3, is extended on shelf part 5, where L-shape member 13 as a movable platform is attached to sheet end 8 with retaining member 17 and articles 12 are arranged on sheet 7 and L-shape member 13. Roller 6 has a drive means of which driving force is spring force by a flat spiral spring. Though the drive means is always generating the power to wind sheet 7 into the inside of roller 6 (or, into the roll-up body for sheet 7), when the article in the front row is brought into contact with wall part 11 as shown in FIG. 1, a force applied from the drive means through sheet 7 to the article in the front row becomes equal to another force applied from wall part 11 to the article in the front row, so that sheet 7 is not rolled up anymore so as to stop the rotating operation of roller 6.

When article 12 which has been arranged on sheet 7 is picked up from the left side of the figure, sheet 7 moves from the right to the left as being wound off, so that article 12 placed thereon also moves to the left. In other words, once the article in the front row is removed from the shelf top, balance of the power collapses, so that sheet 7 is wound off by roller 6 as conveying article 12 forward the shelf, and the article which has been in the second front row moves into the front row. And then, the article in the front row is brought into contact with wall part 11, so that the rotation movement of roller 6 stops again.

Figure 3:
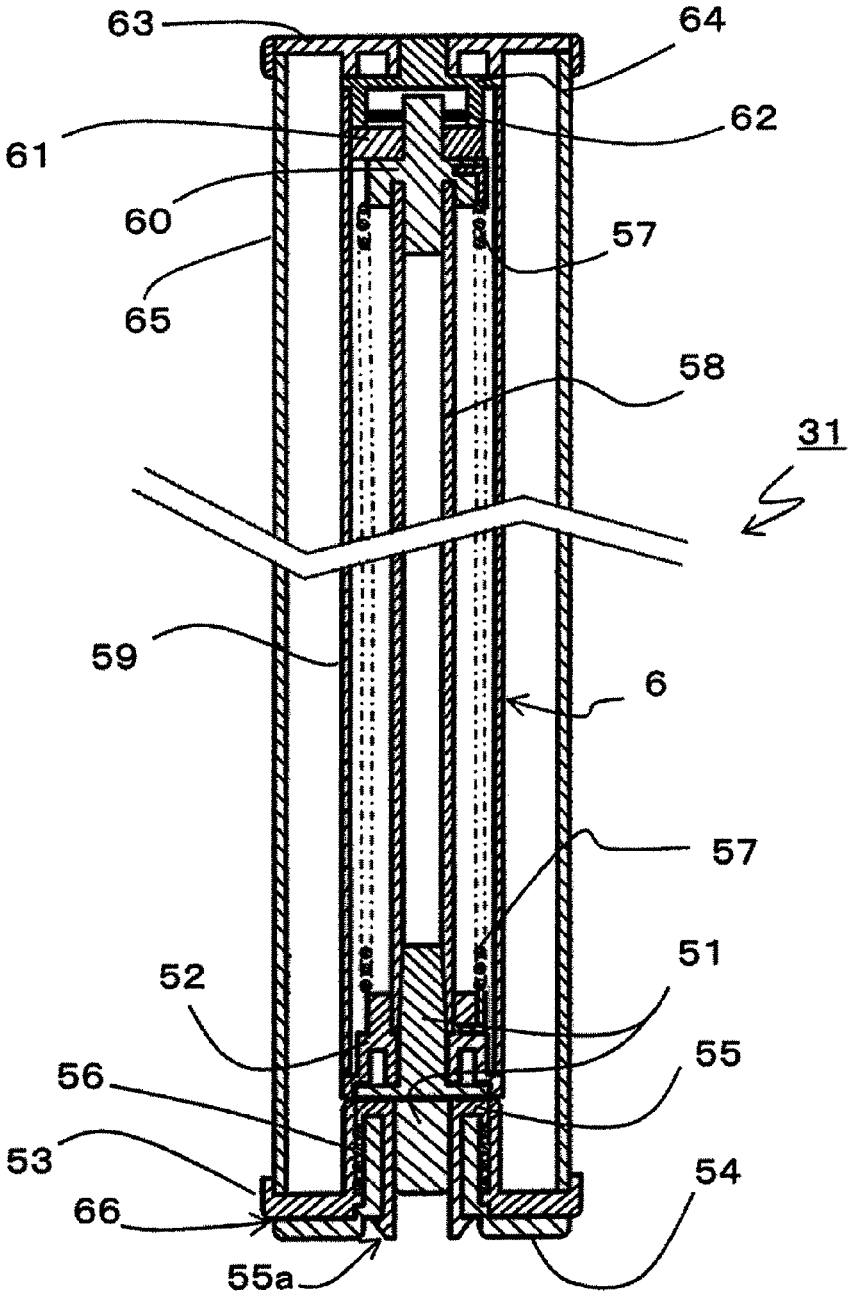
FIG. 3 is a longitudinal sectional view showing the article advancing device in FIG. 1.

In this embodiment, the external form of article advancing device 31 is formed by roller cover 65 which supports roller 6 rotatably and which protects roller 6. Roller cover 65 has an opening part which opens toward the direction in which sheet 7 to be wound by roller 6 is pulled out, and a cover part surrounding an outer periphery of roller 6 in a part other than the opening part. In addition, brackets 53 and 63 shown in FIG. 3 are attached to roller cover 65 at both end surfaces in an axial direction, as surrounding both end surfaces in an axial direction of roller 6. Thus grit and dust, etc., are prevented from adhering to roller 6.

Below roller cover 65, formed is attachment part 2 having a clamp structure, into which an end of shelf part 5 can be fitted so that article advancing device 31 is attached to shelf part. Further, when shelf part 5 is made of metal such as iron, a magnet can be provided on an attaching surface of attachment part 2 so that article advancing device 31 is firmly attached to shelf part 5 easily.

Furthermore, dike part 69 is formed by raising the upper end of roller cover 65 at the side where sheet 7 is pulled out. When article advancing device 31 is used in a low-temperature environment as in a refrigerator, dew might be generated by condensation on an outer surface of roller cover 65 by opening and closing the door of the refrigerator. However, dike part 69 can be provided on roller cover 65, so that the dew generated by the condensation is prevented from flowing into roller cover 65 to touch roller 6.

Further, sheet lifting part 3 through which sheet 7 can pass as being lifted is provided for sheet 7 near roller 6 through wall part 11 provided on roller cover 65. In other words, sheet 7 is once lifted by wall part 11 at a position higher than the extension height on shelf part 5, and then wound off by roller 6. Providing such sheet lifting part 3 near roller 6 helps to shake foreign substances off before coming into roller cover 65 even in case where the foreign substances, such as grit and dust. Thus roller 6 is prevented from driving trouble caused by foreign substances bitten thereinto. Further, providing sheet lifting part 3 helps to prevent L-shape member 13 from coming into roller cover 65 to collide with roller 6 in case where sheet 7 has been completely wound off.

In this embodiment, used can be materials, such as Teflon (registered trademark) which has little friction with shelf part 5 and which has such flexibility that can be easily wound off by roller 6 and other materials coated with it, though there is no limitation to them. Furthermore, when articles of food are arranged on article arrangement shelf 1, it is preferable to use antibacterial materials, which is for example polyester, such as PET.

Figure 2:
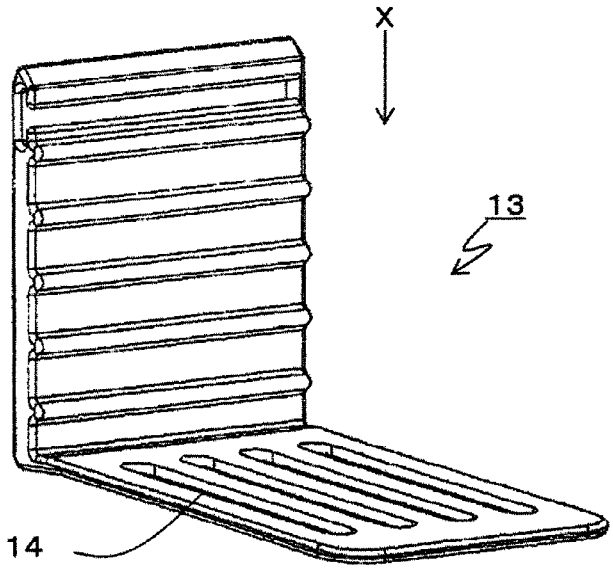
FIG. 2 shows L-shape member in FIG. 1, where (A) is a perspective view and (B) is a plan view from X-direction in (A).
Figure 2:
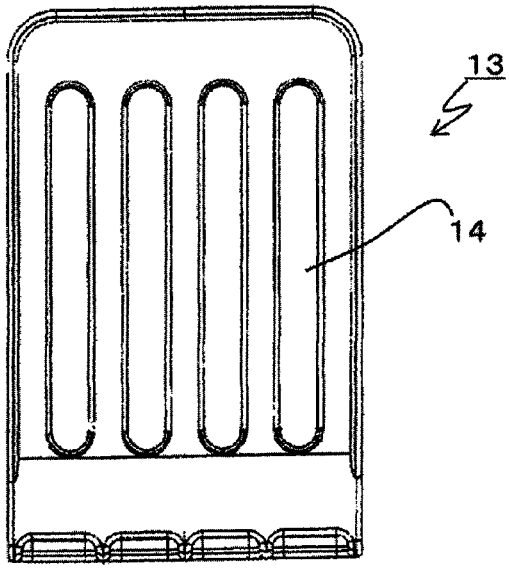

FIG. 2 shows L-shape member 13 in FIG. 1, where (A) is a perspective view and (B) is a plan view from X-direction in (A). L-shape member 13 is made of aluminum material, and convex portions 14 as four linear elements are formed by sheet metal working on the bottom surface along a moving direction of L-shape member 13. Because convex portion 14, whose cross section is formed in a smooth curve, can contact shelf part 5 in FIG. 1 with an extremely small area, static frictional force and dynamic frictional force between L-shape member 13 and shelf part 5 are small. L-shape member 13 which is provided with such convex portion 14, by being attached to sheet end 8 of sheet 7, helps to keep the rotation condition of roller 6 smooth, even when almost a whole length of sheet 7 is wound off by roller 6 so as to make the driving force of roller 6 weakest.

FIG. 3 is a longitudinal sectional view showing article advancing device 31 in FIG. 1. As for Sheet 7, its one end is connected to roller pipe 59, and is pulled out toward the outside of roller 6 from the opening part of roller cover 65. Roller end 64 provided on roller pipe 59 at one end in the axial direction is supported rotatably by bracket 63. Rotator 52 provided on roller pipe 59, at the other end in the axial direction is supported rotatably by stator 51. Stator 51 is assembled integrally with inner pipe 58 and pillow 60. Pillow 60 is supported rotatably by roller end 64, through pillow 61 and push nut 62. Because stator 51 forms a fitting condition with an angular section between shaft holder 55 and driving force adjustment dial 54, it rotates together with shaft holder 55 and driving force adjustment dial 54 during rotation. In addition, driving force adjustment dial 54 is supported rotatably by bracket 53. However in a normal condition, because driving force adjustment dial 54 presses bracket 53 in pressing contact surface 66 by the biasing force transmitted from lock spring 56 via nail part 55*a* of shaft holder 55, driving force adjustment dial 54 cannot rotate relative to bracket 53 unless a strong external force is applied.

In FIG. 3, drive spring 57 as a drive means for rotating roller pipe 59 at an inner periphery of roller pipe 59 is provided, and on end of drive spring 57 is connected to rotator 52 while the other end of drive spring 57 is connected to pillow 60 assembled integrally with stator 51. Therefore, the driving force generated in roller 6 by drive spring 57 is caused by relative torsion between stator 51 and rotator 52. Such a configuration can reduce the diameter of roller 6, so that article advancing device 31 can be placed in front of shelf part 5. Magnitude of the driving force to be generated can be adjusted by turning driving force adjustment dial 54. In addition, it is preferable that stator 51, rotator 52, bracket 53,63, driving force adjustment dial 54, shaft holder 55, pillow 60,61, and roller end 64 are made of resin materials from the viewpoint of easy processing. And specifically, polyacetal (POM) is the most suitable from the viewpoint of strength in a low temperature environment of a refrigerator, etc. As for lock spring 56, a one-way clutch spring of which torsion in a direction for cancelling the accumulative bias is prevented is preferably used. Using the one-way clutch spring as lock spring 56 makes it possible to prevent driving force adjustment dial 54 from turning by reactive force of drive spring 57 to reset the set value of the driving force during adjusting the driving force.

Figure 4:
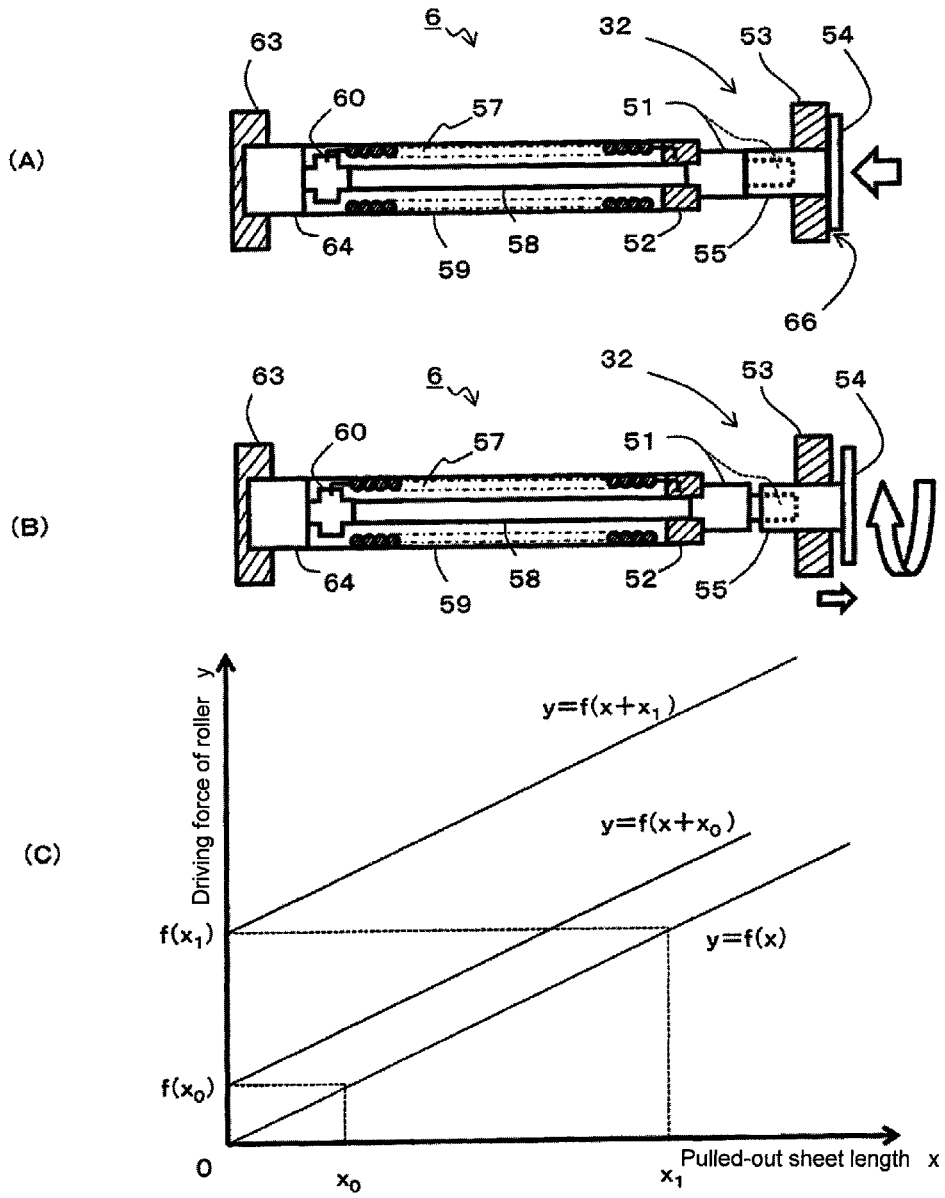
FIG. 4 explains a driving force adjusting mechanism which adjust a driving force of the roller in FIG. 3, where (A) is a schematic longitudinal sectional view showing a normal condition, (B) is a schematic longitudinal sectional view showing a condition where the driving force is adjusted, and (C) is a schematic characteristic diagram showing an adjustment principle of the driving force.

FIG. 4 explains driving force adjusting mechanism 32 which adjust a driving force of roller 6 in FIG. 3, where (A) is a schematic longitudinal sectional view showing a normal condition, (B) is a schematic longitudinal sectional view showing a condition where the driving force is adjusted, and (C) is a schematic characteristic diagram conceptually showing an adjustment principle of the driving force by driving force adjusting mechanism 32. In FIG. 4 (A), because driving force adjustment dial 54 is pressed by bracket 53 in pressing contact surface 66, assembling body, which can only rotate together with driving force adjustment dial 54, consisting of stator 51, inner pipe 58 and pillow 60 cannot rotate relative to bracket 53. Therefore, in FIG. 4 (A), only another assembling body consisting of rotator 52, roller pipe 59 and roller end 64 can rotate with respect to bracket 53, 63 so as to change the accumulative bias condition of drive spring 57.

In the normal condition shown in FIG. 4 (A), the clamping state between driving force adjustment dial 54 and bracket 53 can be canceled by applying an external force to driving force adjustment dial 54 in an axial direction opposite of bracket 53, as shown in FIG. 4 (B). When driving force adjustment dial 54 is turned in such a condition, stator 51 rotates through shaft holder 55. Thus, as for adjusting the driving force, the driving force to be generated in roller 6 can be adjusted by adjusting the accumulative bias condition of drive spring 57 by turning stator 51.

Further, the adjustment principle of the driving force of roller 6 will be explained as referring to FIG. 4 (C). When x implies Pulled-out sheet length and y implies Driving force of roller, the characteristic function showing elastic force of drive spring 57 can be described as $y=f(x)$. According to characteristics of the spring elasticity, "y" becomes minimum at the time of $x=0$ where the pulled-out length of sheet 7 by roller 6 is maximum. However, if "y" the driving force of roller is too small, the article advancing function may not work when the number of articles 12 placed on sheet 7 becomes less. Therefore it is necessary to adjust the roller driving force so that the article advancing function can work even at the time of $x=0$. For example, $f(x0)$ can set the minimum of the roller driving force if only driving force adjustment dial 54 is turned by the number of revolutions equivalent to "x0" the pulled-out length of sheet from the condition $x=0$, as explained by FIG. 4 (B). However, the minimum value of the roller driving force should be set appropriately, for each weight or bottom surface area of article 12 placed on sheet 7. If assuming that the article advancing device of the present invention is applied to a certain article at a condition where the minimum value of the roller driving force has been appropriately set to $f(x0)$, the minimum value of the roller driving force has to be set again to $f(x1)$, in order to change an object article to a heavier article, for example. For such a case, from the initial condition (function: $y=f(x)$) at a driving force adjusting condition shown in FIG. 4 (B), driving force adjustment dial 54 can be turned by the number of revolutions corresponding to "x1" the pulled-out length of sheet, so that the driving force is readjusted. Thus the driving force can be adjusted as keeping the roller driving force sufficient even if most of articles 12 placed on sheet 7 have been taken away.

Figure 5:
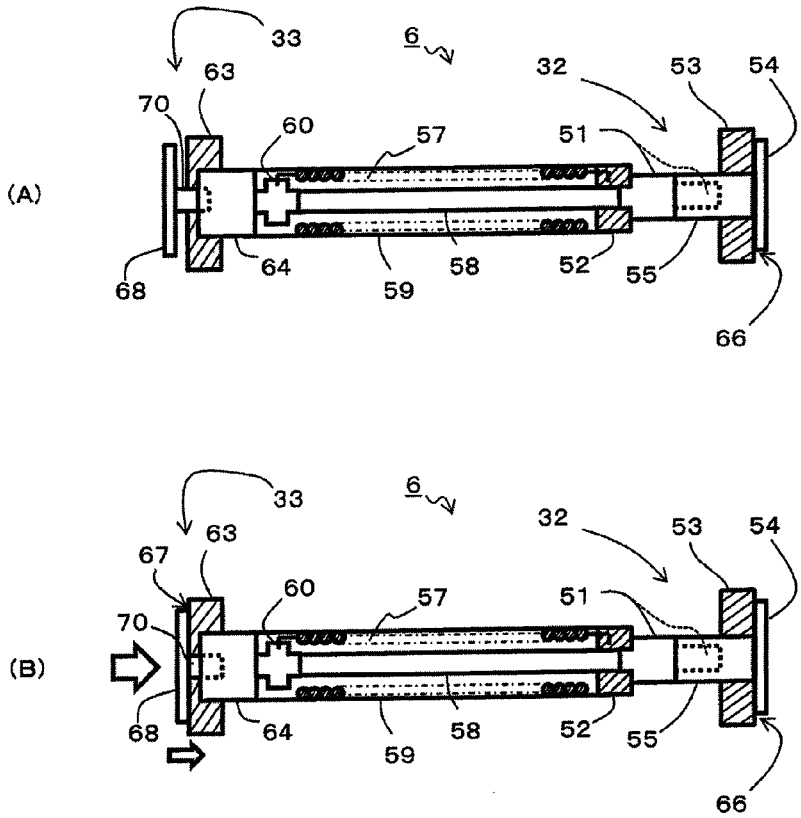
FIG. 5 explains a drive-stopping mechanism which stops driving of the roller in FIG. 3, where (A) is a schematic longitudinal sectional view showing a normal condition, and (B) is a schematic longitudinal sectional view showing a condition where the drive is stopped.

FIG. 5 is a figure, which is an modified example of FIG. 4, for explaining drive-stopping mechanism 33 which stops driving of the roller in FIG. 3. Besides, (A) is a schematic longitudinal sectional view showing a normal condition, and (B) is a schematic longitudinal sectional view showing a condition where the drive is stopped. Roller 6 in FIG. 5 is provided with drive-stopping mechanism 33 having drive-stopping button 68 which can rotate together with roller end 64 through button shaft 70, in addition to driving force adjustment mechanism 32. In the normal condition shown in FIG. 5 (A), roller end 64 and drive-stopping button 68 can rotate relative to bracket 63. On the other hand, in the condition where the drive is stopped, drive-stopping button 68 is pushed into roller end 64 side, so as to form pressing contact surface 67 to bracket 63. Besides, the use of locking structure with lock spring (not shown), makes it possible that the pressing contact condition between drive-stopping button 68 and bracket 63 is still maintained even when the external force which has pushed drive-stopping button 68 into roller end 64 side is removed. In such a pressing contact condition because the assembling body consisting of rotator 52, roller pipe 59 and roller end 64 is stopped rotating by stopping the rotation of button shaft 70, roller 6 is stopped driving. Drive-stopping mechanism 33 can be provided in addition to driving force adjustment mechanism 32 as shown in FIG. 5, and alternatively, drive-stopping mechanism 33 can be provided alone.

Figure 6:
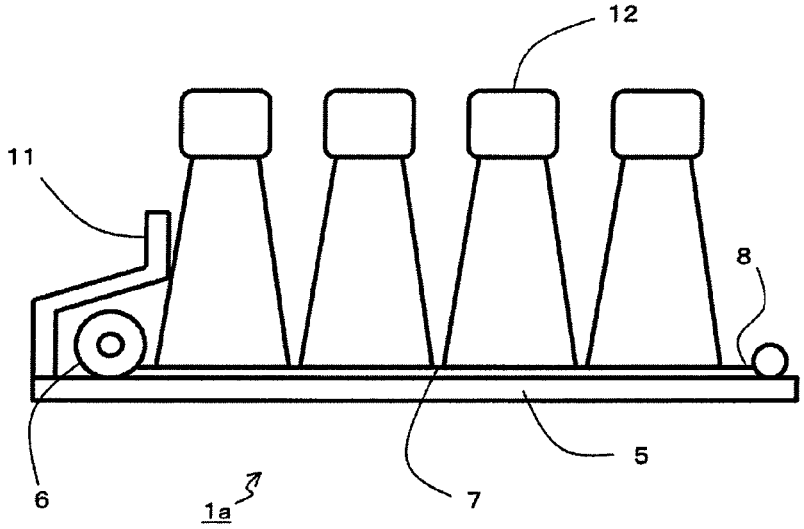
FIG. 6 is a side view showing an article arrangement shelf according to the first embodiment of the present invention.

FIG. 6 is a side view showing an article arrangement shelf according to the first embodiment of the present invention. Article arrangement shelf la is provided with a rigid bar member at sheet end 8. Article arrangement shelf 1*a* in FIG. 6 is provided with neither attachment part 2 nor sheet lifting part 3, differently from article arrangement shelf 1 in FIG. 1. Since the other points are the same as article arrangement shelf 1 in FIG. 1, some explanations will be omitted by giving the same symbols. Some explanations will be omitted as well, even after the second embodiment.

Figure 7:
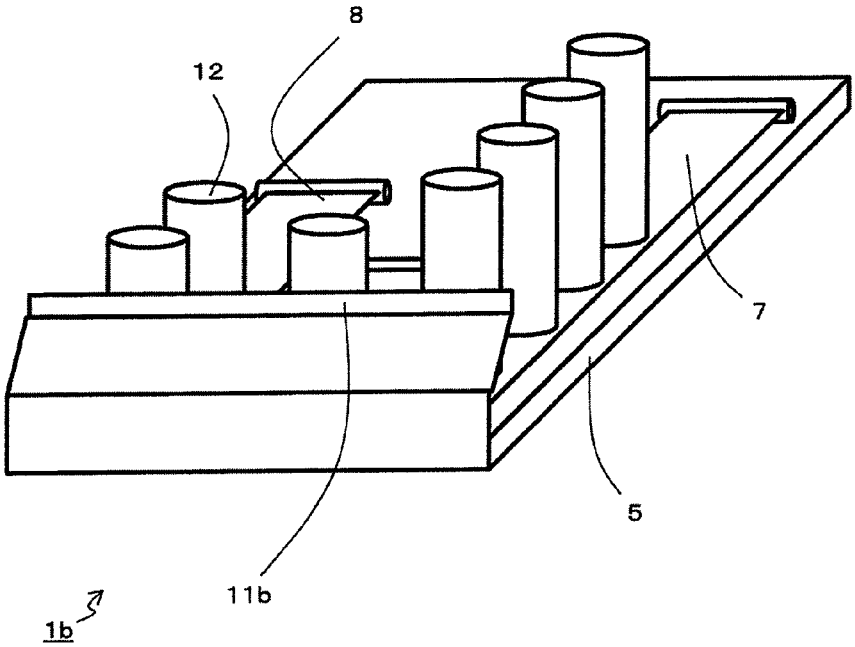
FIG. 7 is a perspective view showing an article arrangement shelf according to the second embodiment of the present invention.

FIG. 7 is a perspective view showing article arrangement shelf 1*b* according to the second embodiment of the present invention. This embodiment is configured such that three article arrangement shelves la are placed in parallel, where shelf part 5 and wall member 11*b* are used in common for three article advancing devices so as to accomplish article arrangement shelf 1*b* as a whole. Though roller 6 is not shown as being hidden by wall member 11*b*, three rollers 6 are placed near wall member 11*b*. Each roller 6 can perform rotational movement independently and can wind sheet 7 independently.

Figure 8:
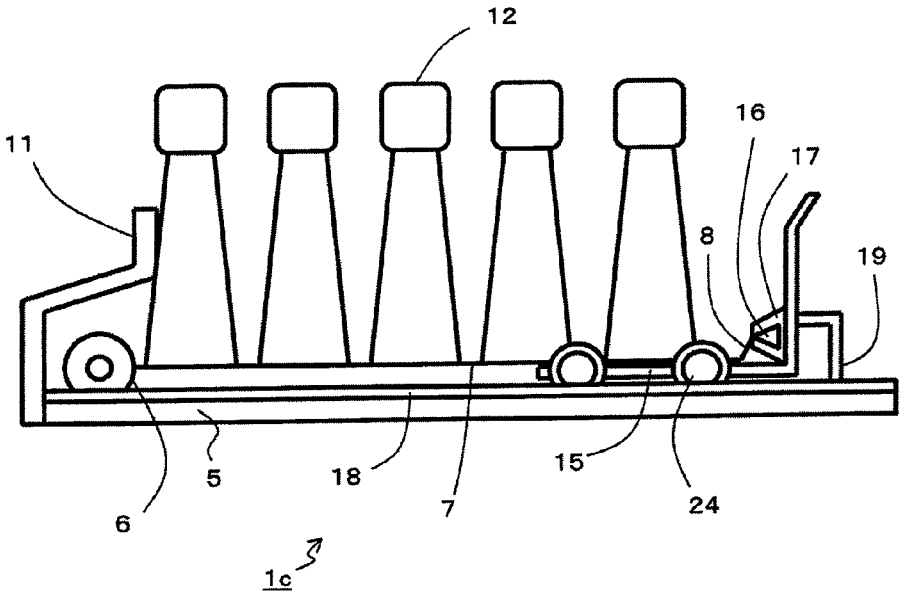
FIG. 8 is a side view showing an article arrangement shelf according to the third embodiment of the present invention.

FIG. 8 is a side view showing article arrangement shelf 1*c* according to the third embodiment of the present invention. Articles 12 are all loaded on sheet 7, and article 12 in the back row, which is the rightmost side of the figure, is placed with sheet 7 on L-shaped truck 17 as a movable platform. Truck 15 is connected to sheet end 8, by sheet holding member 16 whose cross section is triangular and retaining member 17 whose inner surface is shaped along a triangle, and rail 18 is installed on shelf part 5. When sheet 7 is wound off by roller 6 at this condition, truck 15 moves to the left of the figure along rail 18. Truck 15 has wheel 24 as a rotating element, and can move through its rotation with extremely small force, so that article 12 also can be moved (conveyed) extremely smoothly. Further, either in place of wheel 24 or in addition to wheel 24, low-sliding material such as Teflon (registered trademark) can be affixed to the bottom surface of truck 15, so as to reduce friction with rail 18 and the guide surface of the bottom side.

Figure 9:
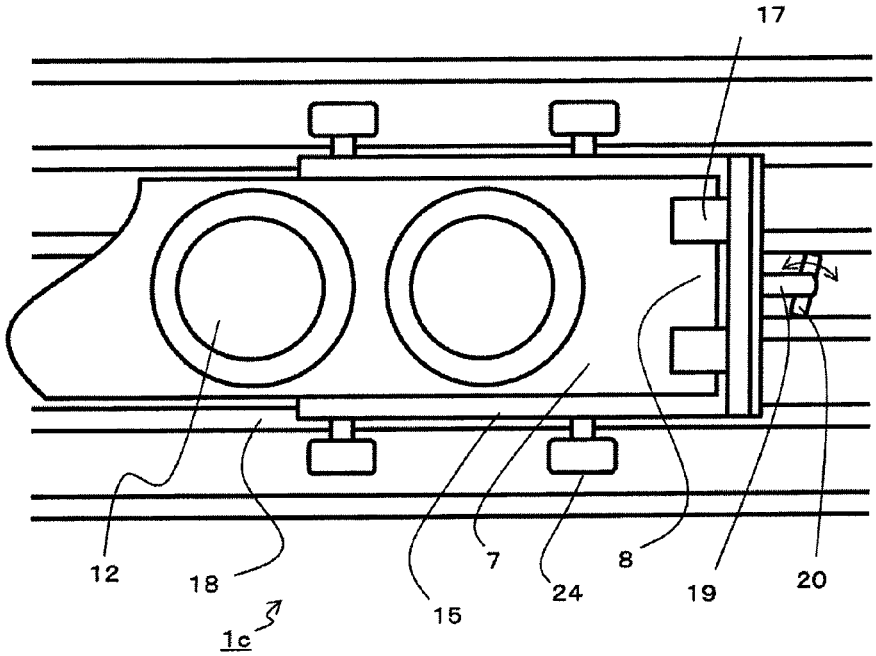
FIG. 9 is a partial plan view showing the article arrangement shelf in FIG. 8.

FIG. 9 is a partial plan view showing article arrangement shelf 1*c* in FIG. 8. Truck 15 is provided with stopping means 19 which extends backward of the shelf (to the right in the figure) from truck 15. In FIG. 9, rotational pad 20 of stopping means 19 has been locked as being pushed between rails. At this condition, because truck 15 does not move in the roll-up direction of the sheet, roller 6 stops rotating. Therefore, even when article 12 has been taken away from the shelf, sheet 7 and truck 15 does not move by forcible stop of operation. When rotary pad 20 of stop means 19 is turned in this state, and a lock state of rotary pad 20 is freed, seat 7 and chassis 15 can work.

Though two pairs of sheet holding member 16 and retaining member 17 are provided in this embodiment, one pair or less than three pairs of sheet holding member 16 and retaining member 17 can be provided, alternatively.

Figure 10:
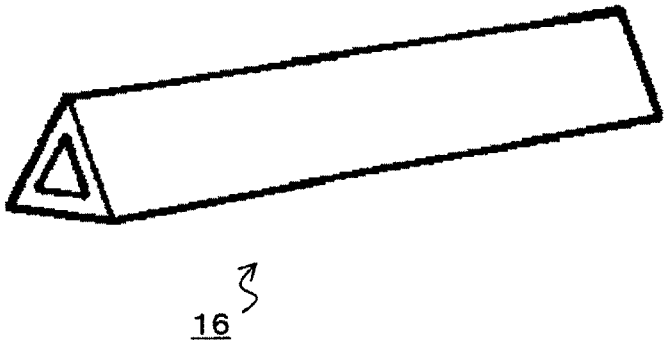
FIG. 10 is a perspective view showing the sheet holding member in FIG. 8.

FIG. 10 is a perspective view showing sheet holding member 16 in FIG. 8. In this embodiment, the cross section is triangular, though it can be an angular shape, such as a rectangle, a pentagon.

Figure 11:
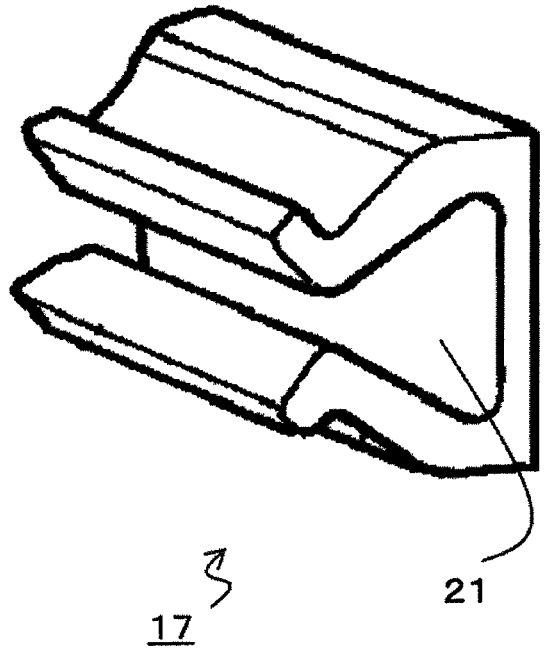
FIG. 11 shows the retaining member in FIG. 8, where (A) is a perspective view and (B) is a side view.
Figure 11:
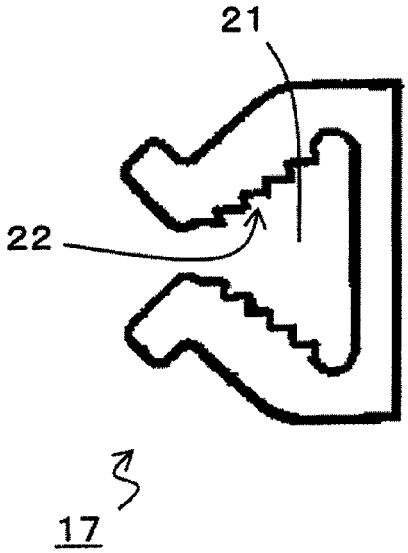

FIG. 11 shows retaining member 17 in FIG. 8, where (A) is a perspective view. Retaining member 17 is provided with inner space 21 for containing sheet holding member 16 around which sheet end 8 is wound, where inner space 21 is formed by penetrating in the width direction of sheet holding member 16. Therefore, sheet holding member 16 around which sheet end 8 is rolled up can be contained in inner space 21 by being laterally slid along the edge of sheet 7 as sheet end 8 is rolled up around sheet holding member 16.

FIG. 11 (B) is a side view of retaining member 17 which is provided convexoconcave 22 for preventing sheet end 8 from loosening. Though the shape of convexoconcave 22 is not limited in particular, if it is concavo-convex shape having the unciform cross section, sheet 7 can be fastened thereby and firmly connected to truck 15 more surely.

Figure 12:
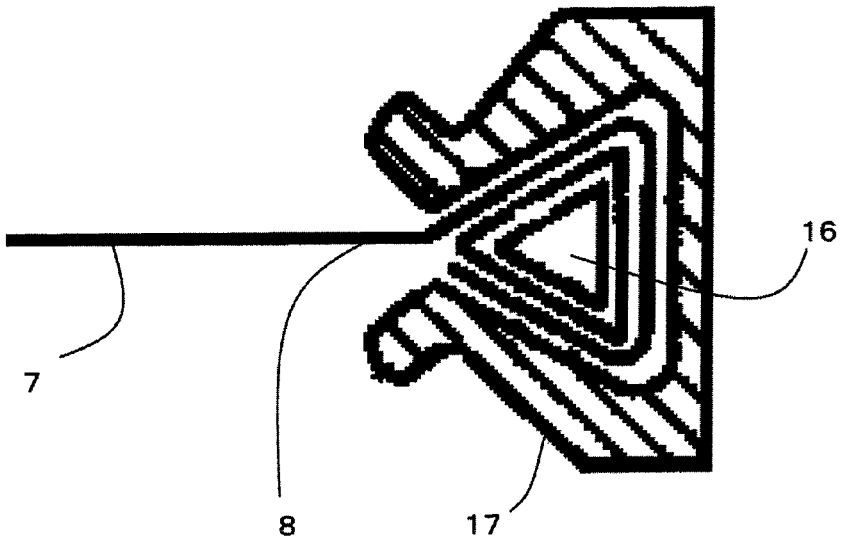
FIG. 12 is a side view showing the connection between the sheet and the truck in FIG. 8.

FIG. 12 is a side view showing the connection between sheet 7 and truck 15 in FIG. 8. In this embodiment, because the cross section of sheet holding member 16 is formed in a triangle and the inner surface is formed in a corresponding triangle, sheet end 8 can be supported and fixed by truck more surely as a wedge effect works to achieve a stopper function spontaneously.

Figure 13:
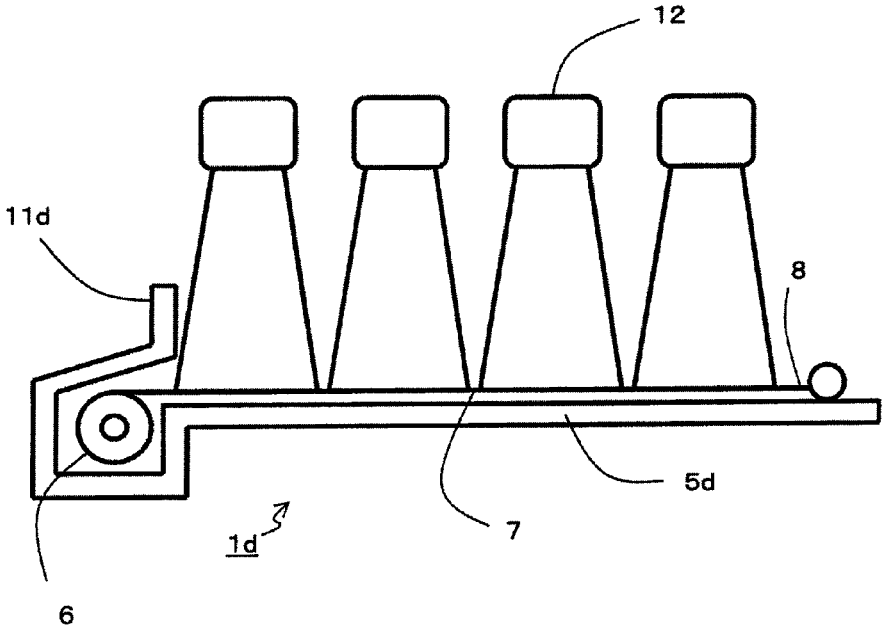
FIG. 13 is a side view showing an article arrangement shelf according to the fourth embodiment of the present invention.

In the present invention, relative height of the roller position to the shelf part can be set arbitrarily. For example, like article arrangement shelf 1*d* according to the fourth embodiment of the present invention shown in FIG. 13, roller 6 can be lowered relative to shelf part 5*d* in the height direction from the position of roller 6 shown in FIG. 6. Further, the height of wall member 11*d* can be relatively lowered. Furthermore, wall member 11*d* can be made adjustable in the height direction, as well as being extensible.

Figure 14:
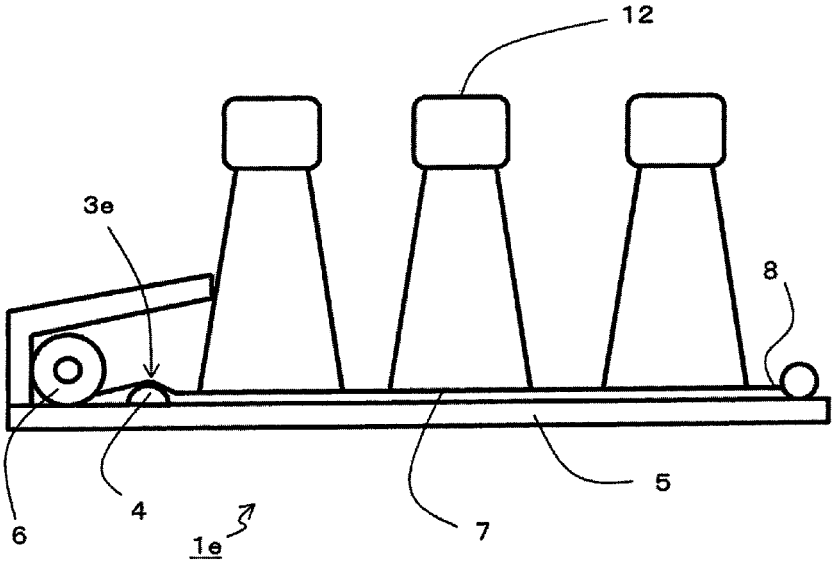
FIG. 14 is a side view showing an article arrangement shelf according to the fifth embodiment of the present invention.

FIG. 14 is a side view showing article arrangement shelf 1*e* according to the fifth embodiment of the present invention. Article arrangement shelf 1*e* is provided with linear convex portion 4 extending in a direction perpendicular to roll-up direction of sheet 7 on shelf part 5, and sheet 7 which is wound by roller 6 can pass, as running upon convex portion 4 near roller 6. Thus sheet lifting part 3*e* is provided as lifting sheet 7 near roller 6 by convex portion 4, so that foreign substances which have been on sheet 7 can be prevented from coming into roller 6.

Figure 15:
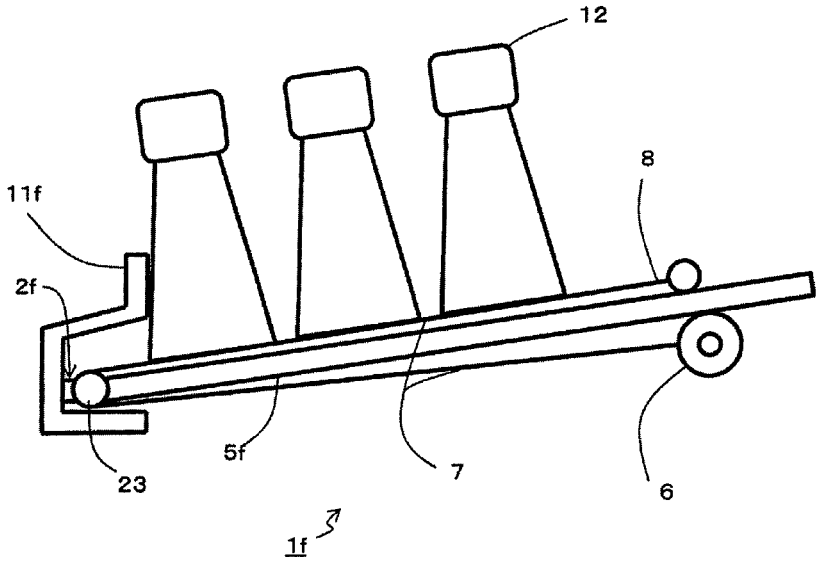
FIG. 15 is a side view showing an article arrangement shelf according to the sixth embodiment of the present invention.

FIG. 15 is a side view showing article arrangement shelf 1*f* according to the sixth embodiment of the present invention. In article arrangement shelf 1*f*, sheet 7 is extended at the side of the bottom surface of shelf part 5*f* through roller pulley 23 which is attached to the end of shelf part 5*f*, where roller 6 is provided at the side of the bottom surface of shelf part 5*f*. Wall member 11*f* is attached to roller pulley 23 with attachment part 2*f*. Shelf part 5*f* is inclined forward in article arrangement shelf 1*f*. Because roller 6 is provided at the side of the bottom surface of shelf part 5*f* inclining forward, roller 6 is difficult to see by consumers. Further, because roller 6 is provided backward in article arrangement shelf 1*f* so that maintenances, such as adjustment of the driving force of roller 6, can be performed from the back side of article arrangement shelf 1*f*, such as in an storage room for the articles, articles can be smoothly supplied onto article arrangement shelf 1*f*. Furthermore, because sheet 7 is turned back by roller pulley 23 from the top surface of shelf part 5*f* and, after passing the bottom surface of shelf part 5*f*, is wound by roller 6, grit and dust placed on sheet 7 fall off when passing the bottom surface of shelf part 5*f*, so as to prevent operational troubles of roller 6.

Industrial Applications of the Invention

The article arrangement shelf with the article advancing device according to the present invention makes it possible to achieve a simple article advancing function without consuming energy, such as electric power, by using a horizontal shelf board which has no inclination basically. The article arrangement shelf with the article advancing device of the present invention is applicable to a display rack installed in convenience stores and an article arrangement shelf installed in warehouses, and specifically suitable as a display rack for goods.

Explanation of Symbols

1, 1*a*, 1*b*, 1*c*, 1*d*, 1*e*, 1*f*: article arrangement shelf
2, 2*f*: attachment part
3, 3*e*: sheet lifting part
4: protrusion portion
5, 5*d*, 5*f*: shelf part
6: roller
7: sheet
8: sheet end
11, 11*b*, 11*d*, 11*f*: wall member
12: article
13: L-shape member
14: convex portion
15: truck
16: sheet holding member
17: retaining member
18: rail
19: stopping means
20: rotational pad
21: inner space
22: convexoconcave
23: roller pulley
24: wheel
31: article advancing device
32: driving force adjusting mechanism
33: drive-stopping mechanism
51: stator
52: rotator
53, 63: bracket
54: driving force adjustment dial
55: shaft holder
55*a*: nail part
56: lock spring
57: drive spring
58: inner pipe
59: roller pipe
60, 61: pillow
62: push nut
64: roller end
65: roller cover
66, 67: pressing contact surface
68: drive-stopping button
69: dike part
70: button shaft

The invention claimed is:

1. An article advancing device comprising a flexible sheet on which articles can be arranged at a condition where said sheet is extended, a roller to which one end of said sheet is fixed and which winds said sheet in a reverse sheet-extension direction, a driver that rotates said roller in a winding direction of said sheet, a wall with which articles present in a first row of said articles arranged on said sheet come into contact, a winding operation of said sheet by said driver is stopped by contact of said articles in said first row with said wall when said articles are arranged on said sheet, and an attacher below said wall that attaches to a shelf part of an article arrangement shelf, said attacher comprising a clamp into which an end of said shelf part is fitted attaching said article advancing device to said end of said shelf part, wherein a movable platform is connected to another end of said sheet, and wherein a connector between said sheet and said movable platform comprises a sheet holder with a modified cross-sectional shape which is wrapped with said one end of said sheet around an outer circumference of said sheet holder, and a retainer which has an opening permitting said sheet to pass through in a condition where said sheet is folded and retains said sheet holder wrapped with said one end of said sheet relative to an extending direction of said sheet itself.

2. The article advancing device according to claim 1, wherein said driver uses a spring force as a driving force.

3. The article advancing device according to claim 1, wherein said driver has a driving force adjuster which can adjust a driving force.

4. The article advancing device according to claim 1, wherein said driver has a driving force adjuster which can adjust a driving force, wherein said roller comprises a drive spring which is biased to enable adjustment of a driving force, a first assembly which supports one end of said drive spring and winds up said sheet by rotation, and a second assembly which supports another end of said drive spring and rotates independently of said first assembly, said driving force adjuster comprises a dial, that is rotatably supported on a roller-end cover and is connected to said second assembly to rotate integrally with said second assembly, and a lock spring that biases said dial against said roller-end cover, and said driving force adjuster is configured to prevent adjustment of said driving force when said dial is biased against said roller-end cover by a biasing force when said dial is biased against said roller-end cover by a biasing force of said lock spring, and to permit adjustment of said driving force when said dial is spaced from said roller-end cover against said biasing force of said lock spring.

5. The article advancing device according to claim 1, wherein said article advancing device further comprises an interrupter that stops operation of said sheet toward said winding direction.

6. The article advancing device according to claim 1, wherein a sheet lifter through which said sheet can pass at a condition where said sheet is lifted is provided for said sheet at a position near said roller.

7. The article advancing device according to claim 1, wherein a rotating element rotating in a moving direction of said movable platform or a linear element extending in a moving direction of said movable platform is provided to said movable platform.

8. The article advancing device according to claim 1, wherein a cross-sectional shape of at least a part of said sheet holder at a position of a sheet extending-direction side is formed as a polygonal shape, and a section of an inner surface of said retainer up to said opening is formed as a shape along said polygonal shape.

9. An article arrangement shelf comprising said shelf part formed or attached with said article advancing device according to claim 1.

10. The article arrangement shelf according to claim 9, wherein said roller is provided on a lower surface side of said shelf part.

11. The article arrangement shelf according to claim 9, wherein said shelf part has a rail or a groove for regulating a moving direction of said movable platform.

12. An article advancing device comprising a flexible sheet on which articles can be arranged at a condition where said sheet is extended, a roller to which one end of said sheet is fixed and which winds said sheet in a reverse sheet-extension direction, a drive means for rotating said roller in a winding direction of said sheet, a wall member with which articles present in a first row of said articles arranged on said sheet come into contact, a winding operation of said sheet by said drive means is stopped by contact of said articles in said first row with said wall member when said articles are arranged on said sheet, wherein a movable platform is connected to another end of said sheet, and wherein a connecting part between said sheet and said movable platform comprises a sheet holding member with a modified cross-sectional shape which is wrapped with said one end of said sheet around an outer circumference of said sheet holding member, and a retaining member which has an opening permitting said sheet to pass through in a condition where said sheet is folded and retains said sheet holding member wrapped with said one end of said sheet relative to an extending direction of said sheet itself.

13. The article advancing device according to claim 12, wherein a cross-sectional shape of at least a part of said sheet holding member at a position of a sheet extending-direction side is formed as a polygonal shape, and a section of an inner surface of said retaining member up to said opening is formed as a shape along said polygonal shape.

* * * * *